US005324602A

United States Patent [19]

Inada et al.

[11] Patent Number: 5,324,602

[45] Date of Patent: Jun. 28, 1994

[54] METHOD FOR FABRICATING A CATHODE RAY TUBE

[75] Inventors: Koki Inada, Chiba; Norihiro Tateyama, Saitama; Osamu Dobashi, Kanagawa, all of Japan

[73] Assignee: Sony Corporation, Tokyo, Japan

[21] Appl. No.: 610,029

[22] Filed: Nov. 7, 1990

[30] Foreign Application Priority Data

Nov. 9, 1989 [JP] Japan ..... 1-291554
May 31, 1990 [JP] Japan ..... 2-139632

[51] Int. Cl.[5] ..... G03C 5/00

[52] U.S. Cl. ..... 430/23; 430/26; 430/29

[58] Field of Search ..... 430/23, 26, 29

[56] References Cited

U.S. PATENT DOCUMENTS 3,614,503 10/1971 Dietch ..... 313/92
4,243,735 1/1981 Kobale et al. ..... 430/25
4,407,916 10/1983 Akagi et al. ..... 430/26

FOREIGN PATENT DOCUMENTS 60-119055 6/1985 Japan .
63-29374 6/1988 Japan .
63-40011 8/1988 Japan .

*Primary Examiner*—Steve Rosasco
*Attorney, Agent, or Firm*—Hill, Steadman & Simpson

[57] ABSTRACT

A method for fabricating a cathode ray tube is described. The method comprises the steps of selectively forming a resist layer corresponding to a pattern of a fluorescent material on an inner surface of the panel of a cathode ray tube, and applying a slurry of a light-absorbing material on the entire inner surface of the panel including the resist layer to form a light-absorbing layer. An inorganic pigment slurry is applied over the entire inner surface of the panel to form an inorganic pigment layer on the light-absorbing layer and then subjected to reverse development to selectively remove the resist layer along with the light-absorbing layer and the white pigment layer, thereby forming a matrix pattern. Finally, a fluorescent material is applied to individual removed portions of the matrix pattern to form a fluorescent pattern. Monochromatic or color cathode ray tubes are obtained with an improved luminance and a colorimetric purity by a simple procedure.

20 Claims, 4 Drawing Sheets

METHOD FOR FABRICATING A CATHODE RAY TUBE

BACKGROUND OF THE INVENTION

1. Field of the Invention

This invention relates to a method for fabricating a cathode ray tube having a high degree of fineness and, more particularly, to an improved method for obtaining a luminance and a colorimetric purity for a cathode ray tube panel.

2. Description of the Prior Art

In order to form images with a high fineness in cathode ray tubes, it is necessary to form a fluorescent layer having a very fine pattern of a distinctly striped or dotted form on a panel surface without any separation. For accurate landing of an electron beam on such a fine pattern, a beam spot has to be converged as small as possible. To supplement the shortage of the luminance, techniques of improving the luminance of the panel surface are essential.

In recent years, however, as the fineness of the panel surface is remarkably improved, it is becoming more difficult to deposit and keep fluorescent particles in an optimum amount in a desired position. This is because when the fluorescent layer containing fluorescent particles is formed in a fine pattern, its adhesion to the panel surface is lowered so that the fluorescent layer is liable to come off at the time of development. Such coming off or removal will cause the color balance to be lost and the luminance to be lowered. It may be considered that if the fluorescent layer is made thin, the layer is prevented from coming off, but it has a lower luminance. Accordingly, there is a strong demand for techniques of effectively preventing the fluorescent layer from coming off when the layer is formed with a relatively large thickness. However, no effective measure has yet been proposed.

On the other hand, several techniques have been proposed for improving the luminance of the panel surface irrespective of the prevention of the fluorescent layer from coming off or being removed.

One such typical example is a metal backing. This is a technique of forming an aluminum thin film having a high light reflectance and a high electron transmittance on the fluorescent layer, for example, according to a vacuum deposition method. Among fluorescence rays which the fluorescent material emits by energization with an electron beam, the component directed toward the back face is reflected in the forward direction to improve the brightness of the picture. Besides, the metal backing has functions of preventing an ion spot and stabilizing the potential of the fluorescent face.

In the metal backing step, prior to the vapor deposition of the aluminum film, a thermally decomposable intermediate film, such as of nitro cellulose, polymethacrylate, acrylic emulsions or the like, is smoothly formed. This intermediate film is removed by decomposition during a subsequent thermal treatment, leaving an aluminum film alone on the inner surface of the panel. In order to improve the luminance of the cathode ray tube, it is essential; to form the aluminum thin film in a state of a mirror surface. To this end, the intermediate layer is formed with a relatively large thickness to absorb the surface irregularities on the fluorescent layer. Alternatively, for the formation of the intermediate film, the inner surface of the panel has water applied thereto, after which a lacquer is developed thereon.

Another approach for improving the luminance of the panel surface is a technique wherein a light reflection layer having a high light reflectance is formed on the light-absorbing matrix, such as by a vacuum deposition, an application of slurry or the like. The present invention defines a light-absorbing matrix as a pattern of a striped or dotted form on a panel surface.

For instance, Japanese Patent Publication No. 63-29374 discloses a technique of depositing a nickel thin film by an electroless plating of nickel-phosphorus selectively on a carbon matrix. In a cathode ray tube Of the type where a fluorescent layer is formed to extend onto the carbon matrix according to a so-called inside exposure method, the nickel thin film can prevent light emitted from the fluorescent particles from being absorbed in the carbon matrix, thereby improving the luminance and the contrast ratio on the panel surface.

Further, similar results are obtained by a technique disclosed in Japanese Patent Publication No. 63-40011, wherein a suspension containing both a light-absorbing material, such as graphite, and a light diffusion and reflection material, such as titanium oxide, is applied on the inner surface of the panel and developed to form a light diffusion and reflection layer on the carbon matrix.

3. Problems to be Solved by the Invention

However, in the prior art techniques, many problems are left to be solved.

First, although the prior techniques show effects to an extent with respect to the improvement in the luminance, the coming-off problem of the fluorescent layer is not solved by any existing technique. More particularly, the light reflection layer formed by plating, vacuum depositing or applying slurries has so smooth a surface that high adhesion to the fluorescent layer cannot be expected. In addition, the technique of forming the light reflection layer by electroless nickel-phosphorus plating is complicated in the formation step.

Second, the improvement of the luminance by the prior art techniques is limited and, especially, the problem of the lowering of the colorimetric purity in the color cathode ray tube has not been solved. This is a problem having a relation to the formation of the fluorescent layer.

The formation of the fluorescent layer can be broadly classified into an inside exposure method wherein light is exposed from the side of the inner surface of the panel and an outside exposure method wherein light is exposed from the outer side of the panel as proposed by the same applicants in Japanese Laid-Open Patent Application No. 60-119055.

In general, in the inside exposure method, the light exposure for forming the fluorescent layer is performed from the inside of the inner surface of a panel glass, so that, as shown in FIG. 5, part of a fluorescent layer 25 is partially extended over a carbon matrix 22. Accordingly, there is, for example, a luminous ray component which is emitted from the fluorescent particles and is directly absorbed in the carbon matrix 22, as shown by arrow $l_{11}$ in FIG. 5, or another luminous ray component, as shown by arrow $l_{12}$, which is reflected from a metal backing film 26 and is then absorbed in the carbon matrix 22. Thus, there exists a problem that the luminance is not improved even though the amount of the fluorescent particles is large.

According to the technique of the Japanese Patent Publication No. 63-29374, the lowering of the luminance can be suppressed to an extent when a thin nickel film is deposited on the carbon matrix. However, since the fluorescent layers are formed by the inside exposure method and the distance between adjacent fluorescent layers becomes small, a luminous ray emitted from a given fluorescent particle passes straightly, as shown by an arrow $l_{13}$, in FIG. 5 or is reflected by the metal backing film 26, as shown by arrow $l_{14}$, with the possibility of entering an adjacent fluorescent layer 25'. With color cathode ray tubes, adjacent fluorescent layers 25, 25' contain fluorescent particles of different colors from each other and, thus, the passing of rays between the layers 25 and 25' will cause the colorimetric purity to be lowered. The thin nickel film does not have such a height as to establish a partition wall between the fluorescent layers 25, 25', so that luminous rays, as shown by the arrows $l_{13}$ and $l_{14}$ cannot be effectively shielded or stopped.

To cope with the problem of the color mixing, there has been proposed a deposition of a thin nickel film only on marginal portions of the carbon matrix 22. In this arrangement, a light-absorbing effect at the central portion of the carbon matrix 22 is expected with the luminance-improving effect being reduced.

The outside exposure method is a technique of enabling one to form self-aligned fluorescent layers through a carbon matrix mask by exposing light from the outside of the panel. According to the outside exposure method, the fluorescent layer 24 is not extended over the carbon matrix 22, as shown in FIG. 4, but is selectively formed on non-formed portion or window portions of the carbon matrix 22. Thus, the uniformity and colorimetric purity can be remarkably improved when this method is applied to color cathode ray tubes.

However, the loss of the luminance cannot be avoided even with the use of the outside exposure method for the following reason. In the outside exposure method, sharp steps are formed between the regions where the thick fluorescent layer 24 has been formed and the regions where the thin carbon matrix 22 has been formed. If, for example, an acrylic emulsion is used to form an intermediate layer (not shown), the emulsion is liable to flow toward a recess (i.e. the carbon matrix). The resultant intermediate film is formed with an incline, which is inevitably provided on a metal backing layer 26 formed thereon. Accordingly, among luminous rays emitted from fluorescent particles, there is a component which is reflected at the inclined face **26*a* of the metal backing film 26, as shown by arrow $l_{10}$, and this reflected component is finally absorbed in the carbon matrix 22** to lead to a loss of the luminance.

The common problem involved in the inside exposure method and the outside exposure method is that a so-called aluminum lifting, i.e., the separation of the metal backing, takes place. This is because, as stated above, the intermediate film is liable to be formed as a thick portion on the carbon matrix and an amount of the gases generated from the thick portion during the thermal decomposition step becomes so large that an additional pressure of the gases is exerted on the metal backing film. The separation results in a lowering of the luminance. In order to avoid the partial difference in the thickness of the intermediate film, the intermediate film may be formed entirely as a thick film. This will contribute to an increase in the degree of the mirror surface of the metal backing film, but will also increase an amount of the gases from the decomposition and unfavorably facilitate the aluminum lifting.

Thus, it is very difficult in the prior techniques to simultaneously achieve the prevention of both the fluorescent layer from coming off and the aluminum lifting and the improvements in the luminance and the colorimetric purity.

SUMMARY OF THE INVENTION

It is therefore an object of the invention to provide a method for fabricating a cathode ray tube which can solve the problems involved in the prior art techniques.

It is another object of the invention to provide a method for fabricating a cathode ray tube with an improved luminance of the cathode ray tube wherein an inorganic pigment layer having relatively great irregularities is formed selectively on a light-absorbing matrix on an inner surface of a panel of the cathode ray tube and serves as a kind of partition wall for adjacent fluorescent layers whereby the fluorescent layers are prevented from coming off and the metal backing film is prevented from separation.

It is a further object of the invention to provide a method for fabricating a color cathode ray tube which has an improved colorimetric purity.

We have made intensive studies in order to achieve the above objects and, as a result, found that when partition walls, which have relatively large irregularities on the surface, are formed on a light-absorbing matrix, it becomes possible (1) to prevent fluorescent layer from coming off due to higher adhesion to the fluorescent layer, (2) to improve the colorimetric purity by physically limiting the region where the fluorescent layer has been formed, (3) to make uniform the steps on the inner surface of the panel and to prevent aluminum lifting owing to this uniformity, and (4) to form pinholes in the metal backing by the action of the surface irregularities to prevent the aluminum lifting.

If white inorganic pigment powders having a high light reflectance are used to form the partition walls, luminous components which are absorbed in the light-absorbing matrix in the prior art can be effectively utilized in addition to the above effects. In addition, when the inorganic pigment powder has a very small size, the fabrication step becomes very simple.

According to the present invention, there is provided a method for fabricating a cathode ray tube of the type which includes a panel having a fluorescent pattern on an inner surface of the panel. The method comprises the steps of:

- selectively forming a resist layer corresponding to a fluorescent pattern on an inner surface of a panel of a cathode ray tube;
- applying a slurry of light-absorbing material on the entire inner surface of the panel including the resist layer to form a light-absorbing layer;
- applying an inorganic pigment slurry dispersing an inorganic pigment powder therein over the entire inner surface of the panel to form an inorganic pigment layer;
- selectively removing the resist layer, the light-absorbing layer and the white pigment layer provided on the resist layer by a reverse development to form a matrix pattern; and
- forming a fluorescent layer at least on the respective removed portions of the matrix pattern.

Preferably, the inorganic pigment slurry is applied by spraying it over the entire inner surface. For this purpose, the inorganic pigment powder used in the slurry should preferably have a size of not larger than 1 $\mu$m.

The removed portions of the matrix pattern where the fluorescent layer is to be formed may be called window portions of the matrix. If fluorescent layers of the three primaries or origin colors are, respectively, applied to the removed portions so that the three primaries are arranged side-by-side in the fluorescent pattern, a color cathode ray tube can be fabricated.

Other advantages and features of the invention will be readily apparent from the following description of the preferred embodiments, the drawings and claims.

BRIEF DESCRIPTION OF THE DRAWINGS

FIGS. 1 and 2 are, respectively, schematic cross sectional views of part of a cathode ray tube fabricated according to the invention wherein FIG. 1 shows a case where a fluorescent layer is formed according to an outside exposure method and FIG. 2 shows a case using an inside exposure method;

FIGS. 3(A) to 3(F) are, respectively, schematic cross sectional views showing a procedure of fabricating a color cathode ray tube of the stripe type in the order of steps wherein FIGS. 3(A) shows the step of forming a resist layer and a carbon layer, FIG. 3(B) shows the step of forming a white pigment layer, FIG. 3(C) shows the step of forming a matrix pattern according to a reverse development, FIG. 3(D) shows the step of forming fluorescent stripes of the three primary colors, FIG. 3(E) shows the step of forming an intermediate film and a metal backing film, and FIG. 3(F) shows the step of removing the intermediate film by decomposition through thermal treatment; and FIGS. 4 and 5 are, respectively, schematic cross sectional views illustrating problems involved in known cathode ray tubes wherein FIG. 4 shows a case where a fluorescent layer is formed according to an outside exposure method and FIG. 5 shows a case using an inside exposure method.

DESCRIPTION OF THE PREFERRED EMBODIMENTS

Figure 1:
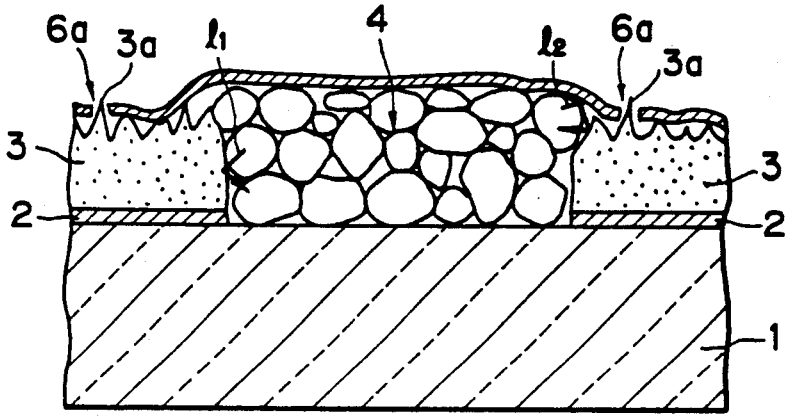

The important aspect of the invention resides in a fact that a light-absorbing layer with a thickness of approximately 1 μm is formed by applying a carbon slurry on an entire surface of an inner surface of a panel by a known method, and a slurry with an inorganic pigment powder dispersed therein is applied and, preferably, sprayed over the entire surface to form an inorganic pigment layer.

The inorganic pigment powder should have thermal stability which is resistant to about 500° C. because the powder is heated to not lower than 400° C., for example in an electric furnace, in a subsequent thermal decomposition step of an intermediate film. Favorable examples of the inorganic pigment material include C, $MnO_2$, CaO, $TiO_2$, $Al_2O_3$, MgO, ZnS and the like. The materials except for the former two materials are white in color and are preferred in those cases where the improvement in the luminance is expected.

For preparing a slurry of the inorganic pigment powder, which is excellent in handling properties, the size of the inorganic pigment powder should preferably be not larger than 1 μm. Care should be paid to the size if commercial products having various particle sizes are available. For example, $TiO_2$powders of the rutile type having a size of 2–3 μm and $TiO_2$ powders of the anatase type having a size of approximately 0.1 μm are commercially sold. In the practice of the invention, the latter powders are favorable.

The inorganic pigment slurry is prepared by mixing the inorganic pigment powder with colloidal silica, pure water and the like.

The colloidal silica is used as an adhesive between the inorganic pigment powder and the light-absorbing layer (usually a carbon matrix). With a commercial product having Si content of about 30%, the silica is preferably used in an amount of 100 to 500 ml per 500 g of $TiO_2$. If the amount is less than the above range, good adhesion cannot be obtained. If the amount is over the above range, the adhesion force becomes great but a problem with the separation of the resist layer during the reverse development will occur.

Pure water is a dispersion medium for the inorganic pigment slurry and is used in an amount of about 500 to 1000 ml per 500 g of $TiO_2$. The amount of pure water influences the viscosity of the resultant inorganic pigment slurry and should be appropriately determined depending on the opening of a spray nozzle.

The inorganic pigment slurry is low in viscosity immediately after the preparation under agitation and may undergo so-called thixotropy wherein the viscosity increases with time when the slurry is allowed to stand. If necessary, dispersants, such as a surface-active agent, may be added in an amount of 0.05 to 0.5 wt % based on the slurry.

In the thus prepared inorganic pigment slurry, coagulums are inevitably formed and the size of the coagulums should preferably be about 20 μm or below for the reason stated hereinafter.

In the practice of the invention, formation of the inorganic pigment layer is effected without use of spin coating by spraying of the inorganic pigment slurry. This is because spraying is more advantageous in increasing the surface irregularities in the inorganic pigment layer. If the coagulums are selected to have a size of about 20 μm or below, the projections having a height of approximately 5 to 25 μm can be formed on the upper surface of the inorganic pigment layer. The dry thickness of the inorganic pigment layer should preferably be in a range of about 10 to 20 μm, although it depends on the diameter of the dots or the pitch of stripes of the matrix pattern (provided that the height of the projections is not included). This range is set from the standpoint that not only is the aspect ratio of the window portions of the matrix pattern made so great as to ensure the contact area with the inorganic pigment layer, but also the inorganic pigment layer will function as a physical partition wall between adjacent fluorescent layers and to provide a satisfactory reflectance when the inorganic pigment is white in color.

It will be noted that the formation of the inorganic pigment layer does not influence either the reverse development, by which the resist layer is removed, or the steps of forming the fluorescent layer and the resist layer.

The fabrication method of the invention comprises, after formation of a light-absorbing layer over an entire surface of an inner surface of a panel by application, for example of a carbon slurry, an additional step of forming an inorganic pigment layer by spraying an inorganic pigment slurry with an inorganic pigment powder dispersed therein. When an inorganic pigment powder having a size of not larger than 1 μm is used, a stable slurry having good handling properties can be prepared and the resulting inorganic pigment layer becomes clear at the edge portions. The inorganic pigment layer can pass water therethrough and does not present any trouble during a reverse development for removal of a resist layer. In addition, the inorganic pigment layer does not influence the steps of forming a fluorescent layer and an intermediate layer. Accordingly, this formation step can readily be incorporated in the existing fabrication processes of cathode ray tubes.

Figure 2:
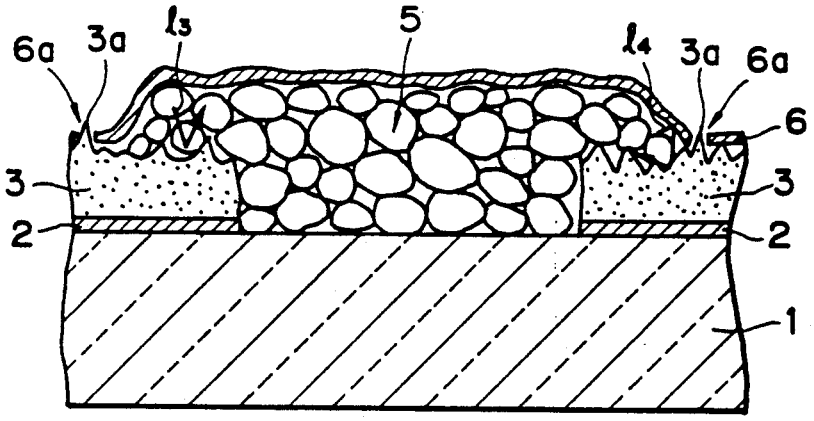

Reference is now made to the accompanying drawings and particularly to FIGS. 1 and 2 wherein part of a panel of a cathode ray tube of the stripe type which is fabricated according to the invention is schematically shown. FIGS. 1 and 2, respectively, show formation of a fluorescent layer according to an outside exposure method and an inside exposure method. In these Figures, like parts are indicated by like reference numerals.

The panels are those which are obtained by forming carbon stripes 2 with given pitches on a glass panel 1 and then an inorganic pigment layer 3, which has a thickness of 10 to 20 times greater than that of the carbon stripe 2, is formed on the stripes 2. A fluorescent layer 4 or 5 is formed on carbon stripe-free portions or window portions and then the entire surface is covered with a metal backing film 6.

The inorganic pigment layer 3 shows various effects in the practice of the invention.

The first effect is prevention of the fluorescent layer 4 or 5 from coming off. Since the inorganic pigment layer 3 has relatively large surface irregularities, the fluorescent layer 4 or 5 formed in contact with the inorganic pigment layer 3 can be strongly kept. Accordingly, thin film formation of the fluorescent layer, which thin film may involve a lowering of the luminance, for the purpose of preventing the fluorescent layer from coming off as in prior art is unnecessary.

The second effect is prevention of the aluminum lifting. Part of the projection 3*a* present in the surface of the inorganic pigment layer 3 reaches the metal backing film 6 and passes therethrough to thereby form fine pinholes 6*a*. The pinholes 6*a* function as a kind of vent ports when an intermediate layer (not shown) is removed by thermal decomposition, so that any lifting of the metal backing film 6 does not take place. This allows the formation of a thick intermediate film, along with the advantage that the degree of mirror surface of the metal backing film 6 can be increased.

The third effect is that, especially in color cathode ray tubes, the colorimetric purity can be improved. The inorganic pigment layer 3 contributes to an increase in the aspect ratio of the window portions. Since the thickness of the fluorescent layer 4 or 5 is the same as that in prior art, the inorganic pigment layer 3 functions as a partition wall for separating the fluorescent layers. More particularly, the. inorganic pigment layer 3 not only physically limits a region where the fluorescent layer 4 or 5 is formed and, especially, where the fluorescent layer is formed according to the inside exposure method, but also inhibits a luminous component from entering adjacent fluorescent layers. Thus, it is expected that the colorimetric purity is improved in color cathode ray tubes.

If the inorganic pigment layer 3 is constituted of white inorganic pigments, the luminance can also be improved for the following reason.

With the fluorescent layer 4, which is formed according to the outside exposure method as shown in FIG. 1, fluorescence $l_1$ emitted from a fluorescent particle is reflected at the side wall of the inorganic pigment layer 3. In addition, fluorescence $l_2$, which would be absorbed in the light-absorbing matrix in the prior art, is reflected with a metal backing film 6 and then also reflected by an upper portion of the inorganic pigment layer 3. These components are returned to the interior of the fluorescent layer 4.

Such an effect is similarly produced with the fluorescent layer 5, which is formed by the inside exposure method, as shown in FIG. 2. Luminous rays $l_3$ and $l_4$ emitted from the fluorescent particles are similarly returned to the interior of the fluorescent layer 5. Thus, the effective utilization of the light emission of the fluorescent particles is possible with an improved luminance of the panel.

With the color cathode ray tubes, the color mixing will be avoided, due to the presence of the inorganic pigment layer 3, with an increasing allowance of beam landing.

A preferred embodiment of the invention which is applied to fabrication of a color cathode ray tube of the striped type according to an outside exposure method using white $TiO_2$ as the inorganic pigment is more particularly described with reference to FIGS. 3(A) to 3(F).

The arrangement of a panel of the color cathode ray tube fabricated according to this invention is similar to that shown in FIG. 1.

Figure 3A:
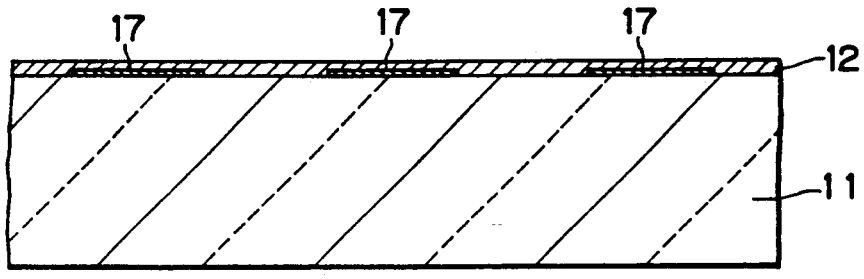

A photoresist aqueous solution, such as, for example, an aqueous solution obtained by dissolving 8 wt % of ammonium bichromate based on polyvinyl alcohol in 1.5% polyvinyl alcohol aqueous solution, was spin coated on an inner surface of a glass panel 11 and dried. Thereafter, UV exposure was effected three times using an aperture grill as an optical mask in such a way that the position of an exposure light source was shifted corresponding to positions of light sources for red, green and blue colors, followed by developing treatment to selectively form a resist layer 17 corresponding to a fluorescent pattern, as shown in FIG. 3(A). Subsequently, a carbon slurry was applied over the entire inner surface of the panel 11 including the resist layer 17 and dried to form a carbon layer 12. The thickness of the carbon layer 12 is about 1 μm in portions where no resist layer 17 has been formed.

Figure 3B:
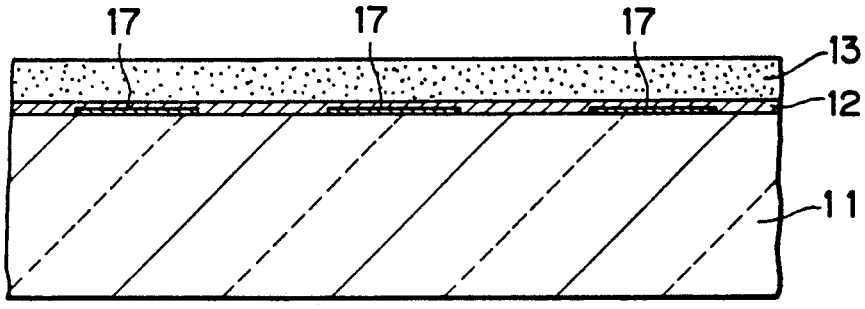

As shown in FIG. 3(B), an inorganic pigment slurry with an inorganic pigment powder dispersed therein was sprayed over the entire inner surface of the panel and dried to form an about 15 μm thick inorganic pigment layer 13. An example of a composition of the inorganic pigment slurry used was composed of 350 g of $TiO_2$ powder (extra pure reagent, anatase, particle size 0.1 μm, available from Kanto Chem. Co., Ltd.), 280 ml of colloidal silica (Si content of 30%, commercial name: Rudox AM, available from Du Pont de Nemours), 8 ml of an acrylic emulsion (acryl content of 10%, commercial name: Primal 850, Rhom & Haars Inc.) and 600 ml of pure water. A surface-active agent was added as a dispersant so that a stable slurry having good handling properties could be prepared.

Figure 3C:
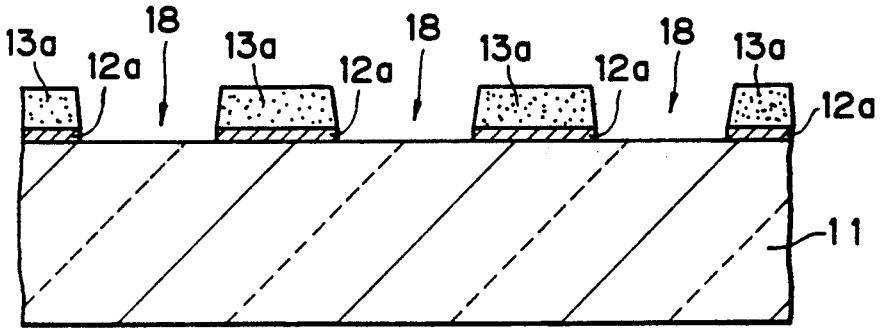

Either a hydrogen peroxide aqueous solution or a periodic acid aqueous solution, which is used as a reverse developing agent for decomposing the resist layer 17, was injected into the panel, followed by blowing water to remove the resist layer 17 along with any of the portions of the carbon layer 12 and the inorganic pigment layer 13 formed on the resist layers 17. The hydraulic pressure used when blowing the water should be set at a level slightly higher than in known fabrication processes wherein any inorganic pigment layer is not formed. By this, as shown in FIG. 3(C), a matrix pattern consisting of the carbon stripes 12*a* and the inorganic pigment layers 13*a* formed thereon was formed with clear edges. The non-formed portions of the matrix pattern were window portions 18.

Figure 3D:
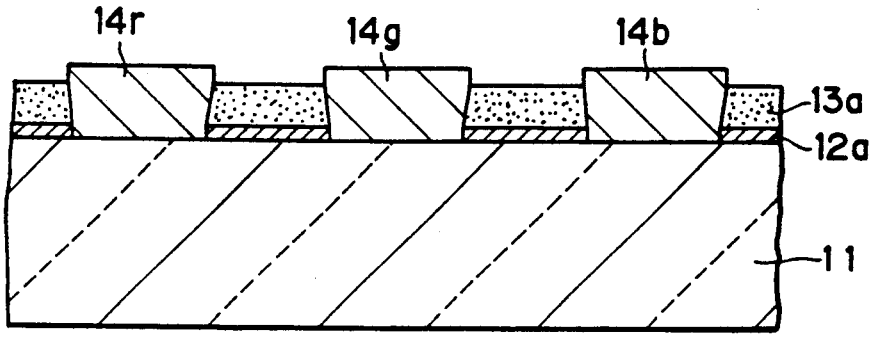

As shown in FIG. 3(D), a red fluorescent stripe 14*r*, a green fluorescent stripe 14*g* and a blue fluorescent stripe 14*b* were formed in the window portions 18 according to a known outside exposure method with each stripe having a thickness of about 20 μm. Thus, the pigment layer 13 is approximately 75% as thick as the fluorescent stripes 14*r*, 14*g* or 14*b*. The exposure was made from the outer side of the glass panel 11 through the matrix pattern as an optical mask, so that the respective fluorescent stripes 14*r*, 14*g* and 14*b* did not extend over the upper surface of the respective white pigment layers 13*a*, but were selectively formed on the window portions alone. For the formation of the respective color fluorescent stripes, fluorescent slurries were applied and dried, followed by exposure to light and development with water. In the practice of the invention, the adhesiveness of the fluorescent stripes was improved and the drop-off failure of the fluorescent stripes at the time of the development with water was reduced by about 20%.

Figure 3E:
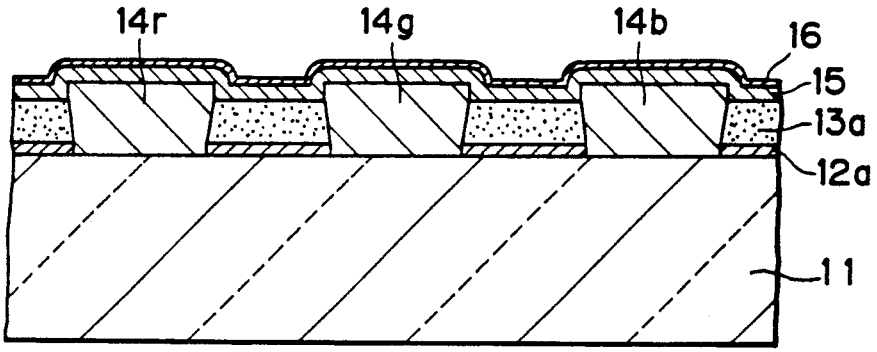
Figure 3F:
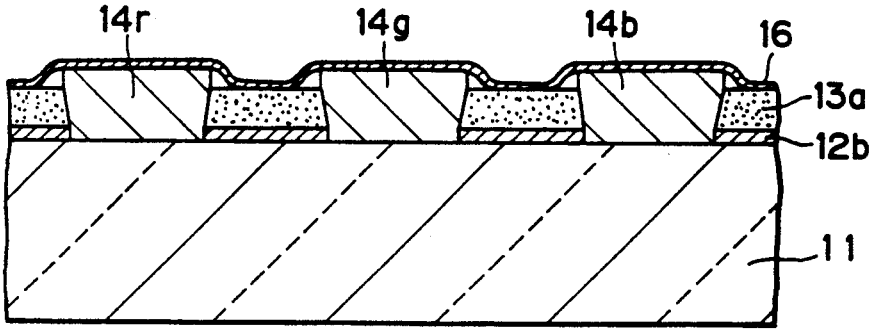
Figure 4:
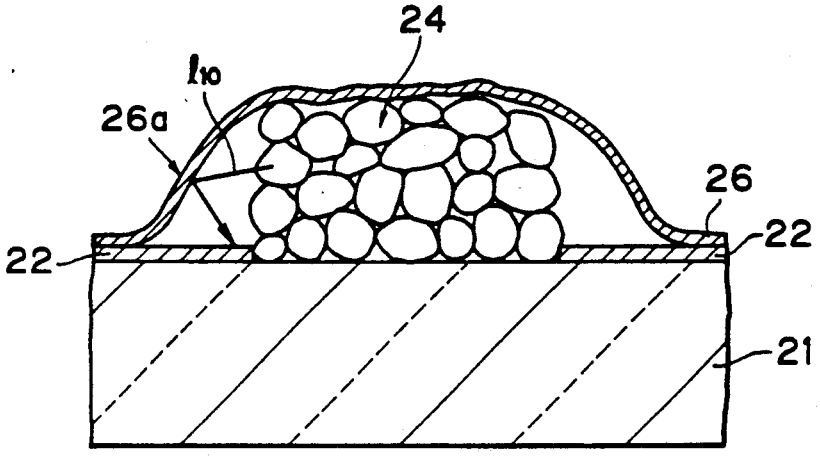
FIG. 4 (PRIOR ART)
Figure 5:
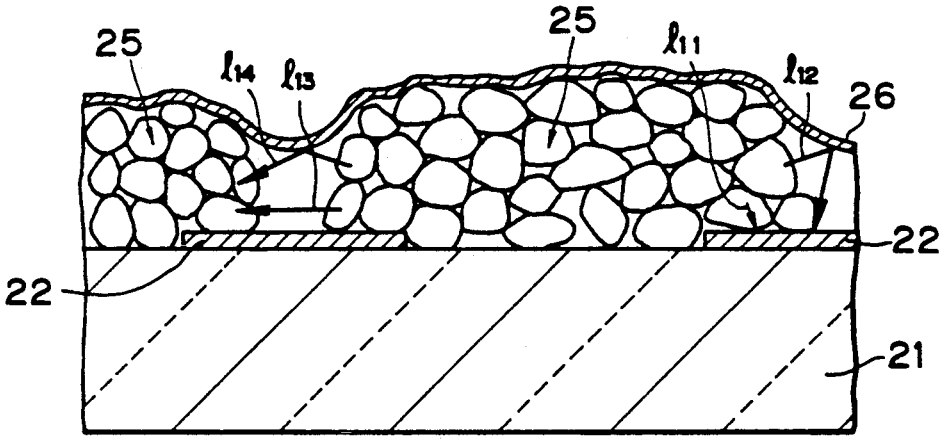
FIG. 5 (PRIOR ART)

Thereafter, as shown in FIG. 3(E), the inner surface of the panel was entirely covered, for example, with an acrylic emulsion to form an intermediate film 15. The intermediate film 15 was formed by a two-layer coating method. The main purpose of the two-layer coating method was to improve mirror surface properties of a metal backing through an improvement in the smoothness of the intermediate film, thereby improving the brightness of the picture. In general, when a binder of the fluorescent layer having cationic properties and an acrylic emulsion having anionic properties are contacted, the acrylic ingredient will fail to properly disperse to cause an irregular coating of the intermediate film, which results in a deterioration of the mirror surface properties of the metal backing. To avoid this, a non-ionic acrylic emulsion (commercial name: Primal C-72, Rhom & Haars Inc.) was used as a first layer (formed at the side of the fluorescent layer) and an anionic acrylic emulsion (commercial name: Primal C-72, Rhom & Haars Inc.) was used as a second layer. By this, the smoothness of the intermediate film 15 was improved and the discoloration was prevented from occurring as would conventionally take place since the pH was shifted toward an acid side. This intermediate film 15 was formed on the inner surface of the panel with a reduced surface step and results in a reduced irregularity in the film thickness.

The formation of the intermediate film 15 could be made, aside from the application of the acrylic emulsion, by applying water on the inner surface of the panel and developing a lacquer. In this case, the inorganic pigment layer 13*a* and the fluorescent stripes 14*r*, 14*g* and 14*b* should preferably be formed substantially at the same height.

Subsequently, a metal backing film 16 is formed such as by vacuum deposition of aluminum on the intermediate film 15.

Next, a thermal treatment was effected at a temperature of about 420° C. to remove the photosensitive resins from the intermediate film 15 and the fluorescent stripes 14*r*, 14*g* and 14*b* with the respective colors by thermal decomposition. This step produces a panel with an inner surface provided with the fluorescent stripes 14*r*, 14*g* and 14*b* and the inorganic pigment layers 13*a* covered with the metal backing film 16. In this thermal treatment, since the intermediate film 15 was formed substantially in a uniform thickness and the metal backing film 16 was formed with fine pinholes by the action of the projections on the upper surface of the inorganic pigment 13*a* (see points 3*a* of FIGS. 1 or 2), aluminum lifting caused by generation of gases by thermal decomposition was not observed.

The panel fabricated in this manner was assembled in a color cathode ray tube according to an ordinary procedure to measure its luminance. Comparison with known color cathode ray tubes where any inorganic pigment layer 13*a* was not formed revealed that with a 20 inch size cathode ray tubes, the luminances for the respective colors were improved by 10% to 15% and with 36 inch size cathode ray tubes, luminances of some cathode ray tubes were improved by 30%.

The reason why the luminance is improved when the present invention is applied is that most of the side walls of the fluorescent stripes 14*r*, 14*g* and 14*b* are contacted with the inorganic pigment layers 13*a* and luminous rays emitted from the fluorescent particles are reflected back into the fluorescent particles by the inorganic pigment layer along with light reflected at inclined portions of the metal backing film 16 being reflected toward the upper surface of the inorganic pigment layers 13*a*. As a result, the amount of the luminous ray components absorbed directly in the carbon stripes 12*a* becomes very small.

In the foregoing, the fabrication of the color cathode ray tubes of the striped type has been described. Similar results are obtained when the present invention is applied to color cathode ray tubes of the dotted type and monochromatic cathode ray tubes.

As will become apparent from the above, according to the method of the invention for fabricating a cathode ray tube, improvements of the luminance through formation of a thick fluorescent layer, prevention of the fluorescent layer from coming off and prevention of aluminum lifting are achieved. Especially, with color cathode ray tubes, the colorimetric purity can be improved in addition to the above advantages. Moreover, when white materials are used as the inorganic pigment, the luminous component of fluorescent materials is effectively utilized with a greater advantage in attaining high luminance. The above step can be readily incorporated in an existing fabrication line of cathode ray tubes without needing much additional equipment costs and without a reduction of productivity.

In the cathode ray tubes fabricated according to the invention, the allowance of beam landing is increased due to the presence of the inorganic pigment layer so that while a degree of freedom of design is increased, the fineness can be readily attained.

Although various minor modifications may be suggested by those versed in the art, it should be understood that we wish to embody within the scope of the patent granted hereon all such modifications as reasonably and properly come within the scope of our contribution to the art.

We claim:

1. A method for fabricating a cathode ray tube of the type which includes a panel having a fluorescent pattern on an inner surface of the panel, the method comprising the steps of:

selectively forming a resist layer corresponding to a fluorescent pattern on an inner surface of a panel of a cathode ray tube;

applying a slurry of a light-absorbing material on the entire inner surface of the panel including the resist layer to form a light-absorbing layer;

applying an inorganic pigment slurry with an inorganic pigment powder dispersed therein over the entire light-absorbing layer to form a pigment layer having surface irregularities and a substantial thickness;

selectively removing the resist layer and portions of the light-absorbing layer and the pigment layer provided on the resist layer by a reverse development to from a light-absorbing pattern having removed portions separated from each other; and forming a fluorescent layer at least on the respective removed portions of said light-absorbing pattern with the pigment layer acting as a partition wall for separating the fluorescent layer in adjacent removed portions.

2. A method according to claim 1, wherein said light-absorbing pattern is carbon.

3. A method according to claim 1, wherein said pigment layer is made of a powder of a pigment selected from a group consisting of C and $MnO_2$.

4. A method according to claim 1, wherein said pigment layer is made of a powder of a white pigment.

5. A method according to claim 4, wherein said white pigment is a member selected from a group consisting of CaO, $TiO_2$, $Al_2O_3$, MgO and ZnS.

6. A method according to claim 1, wherein said powder has a size of not larger than 1 $\mu$m.

7. A method according to claim 1, wherein said pigment slurry comprises the inorganic pigment powder, colloidal silica and pure water.

8. A method according to claim 7, wherein said pigment slurry further comprises an acrylic emulsion as a dispersant.

9. A method according to claim 1, wherein said pigment slurry is sprayed over the entire light-absorbing layer.

10. A method according to claim 1, wherein said pigment layer is formed in a thickness of a range of 10 to 20 times greater than the thickness of the light-absorbing layer.

11. A method according to claim 1, which includes applying an intermediate layer of two sub-layers on the fluorescent layer and the pigment layer of said light-absorbing pattern.

12. A method according to claim 11, which includes forming a thin metal backing layer on the intermediate layer and then thermally decomposing the intermediate layer.

13. A method according to claim 1, wherein fluorescent layers of three primary colors are formed at least on the removed portions so that the three primary colors are arranged side-by-side in the fluorescent pattern whereby a color cathode ray tube is obtained.

14. A method according to claim 1, wherein the step of applying an inorganic pigment slurry sprays the slurry onto the light-absorbing layer.

15. A method for fabricating a cathode ray tube of a type which includes a panel having a fluorescent pattern on an inner surface of the panel, the method comprising the steps of:

selectively forming a resist layer corresponding to a fluorescent pattern on an inner surface of a panel of a cathode ray tube;

applying a slurry of a light-absorbing material on the entire inner surface of the panel including the resist layer to form a light-absorbing layer;

applying an inorganic pigment slurry with an inorganic pigment powder dispersed therein over the entire light-absorbing layer to form a pigment layer having surface irregularities;

selectively removing the resist layer and portions of the light-absorbing layer and the pigment layer provided on the resist layer by a reverse development to form a light-absorbing pattern with window portions;

forming a fluorescent layer at least on the respective window portions of the light-absorbing pattern;

applying an intermedialayers of said light-absont layer and the pigment layers of said light-absorbing pattern;

forming a thin metal backing layer on said intermediate layer; and subsequently thermally decomposing the intermediate layer.

16. A method according to claim 15, wherein said step of applying an inorganic pigment slurry provides an inorganic pigment slurry having a powder selected from a group consisting of C and $MnO_2$.

17. A method according to claim 15, wherein the pigment layer is made up of a powder of a white pigment.

18. A method according to claim 17, wherein the white pigment is selected from a group consisting of CaO, $TiO_2$, $Al_2O_3$, MgO and ZnS.

19. A method according to claim 15, wherein said pigment layer is formed in a thickness of about 75% of the thickness of the fluorescent layer and acts as a partition wall to prevent light from passing between fluorescent layers in adjacent window portions.

20. A method according to claim 15, wherein the step of applying the inorganic pigment slurry sprays the slurry over the entire light-absorbing layer.

* * * * *